US008642864B2

(12) United States Patent
Bordelon

(10) Patent No.: US 8,642,864 B2
(45) Date of Patent: Feb. 4, 2014

(54) MULTI-PURPOSE PLECTRUM

(76) Inventor: Kirt Bordelon, Harrington, DE (US)

( * ) Notice: Subject to any disclaimer, the term of this patent is extended or adjusted under 35 U.S.C. 154(b) by 0 days.

(21) Appl. No.: 13/284,864

(22) Filed: Oct. 28, 2011

(65) Prior Publication Data

US 2013/0104722 A1 May 2, 2013

(51) Int. Cl.
*G10D 3/16* (2006.01)

(52) U.S. Cl.
USPC ..... 84/322

(58) Field of Classification Search
USPC ..... 84/322
See application file for complete search history.

(56) References Cited

U.S. PATENT DOCUMENTS

| | | | | | |
|---|---|---|---|---|---|
| 768,241 | A | * | 8/1904 | Seidel | 84/322 |
| 1,573,912 | A | * | 2/1926 | Burdwise | 84/322 |
| 2,484,820 | A | * | 10/1949 | Galetzky | 84/322 |
| D215,029 | S | * | 8/1969 | Gardsby | D17/20 |
| 3,648,558 | A | * | 3/1972 | Chenette | 84/322 |
| 4,137,814 | A | * | 2/1979 | Rowley | 84/322 |
| 4,248,128 | A | | 2/1981 | Des Gaines | |
| D260,529 | S | * | 9/1981 | Pearse | D17/20 |
| 4,365,537 | A | * | 12/1982 | Pogoda | 84/454 |
| 4,398,444 | A | | 8/1983 | Walker | |
| D292,413 | S | * | 10/1987 | Slusser | D17/20 |
| 4,790,227 | A | | 12/1988 | Lukehart | |
| D310,233 | S | * | 8/1990 | Farnell, Jr. | D17/20 |
| D317,617 | S | * | 6/1991 | Mutti | D17/20 |
| D336,102 | S | * | 6/1993 | Hodesh | D17/20 |
| D358,833 | S | | 5/1995 | Ridley et al. | |
| 5,594,189 | A | | 1/1997 | Latteri | |
| 6,130,374 | A | | 10/2000 | Polidori | |
| 6,242,677 | B1 | * | 6/2001 | Sander | 84/322 |
| 6,335,477 | B1 | | 1/2002 | Miller | |
| 6,342,661 | B1 | | 1/2002 | Flamm | |
| D489,773 | S | * | 5/2004 | Manville | D21/484 |
| 6,777,602 | B2 | * | 8/2004 | Hautamaki et al. | 84/322 |
| 6,903,256 | B2 | * | 6/2005 | Pittman et al. | 84/322 |
| 7,067,729 | B2 | | 6/2006 | Leong | |
| 7,238,869 | B1 | * | 7/2007 | Kleckzka | 84/322 |
| D557,330 | S | * | 12/2007 | Parikh et al. | D17/20 |
| 7,427,705 | B2 | * | 9/2008 | Rubens | 84/320 |
| 7,459,620 | B1 | | 12/2008 | Kester | |
| 7,462,768 | B2 | * | 12/2008 | Newmaster | 84/322 |
| D607,920 | S | | 1/2010 | Bartel | |

(Continued)

FOREIGN PATENT DOCUMENTS

| | | | |
|---|---|---|---|
| CN | 200997267 | Y | 12/2007 |
| DE | 202006015484 | U1 | 12/2006 |
| DE | 102006047831 | A1 | 4/2008 |
| FR | 2941323 | A1 | 7/2010 |

*Primary Examiner* — Robert W Horn
(74) *Attorney, Agent, or Firm* — Christopher Wood; Premier Law Group, PLLC

(57) ABSTRACT

The plectrum includes a first lobe, a second lobe, a third lobe, a recessed edge, and a convex edge. Grasping the plectrum with the recessed edge resting against the web between the thumb and forefinger of a user's hand allows the user to strum or pluck a string of a string instrument with either the third lobe or the convex edge. The plectrum may also be grasped to allow a user to strum or pluck one or more strings of a string instrument with the first lobe and the second lobe.

19 Claims, 4 Drawing Sheets

(56) References Cited

U.S. PATENT DOCUMENTS

| | | | | |
|---|---|---|---|---|
| 7,799,979 | B2 | 9/2010 | Swartz | |
| D632,729 | S | 2/2011 | Goad | |
| 8,178,767 | B1 * | 5/2012 | King | 84/322 |
| D672,385 | S * | 12/2012 | Goad | D17/20 |
| D673,999 | S * | 1/2013 | Walker | |
| 2004/0194607 | A1 * | 10/2004 | Leong | 84/322 |
| 2005/0204893 | A1 | 9/2005 | Luschniu | |
| 2006/0117931 | A1 * | 6/2006 | Benyahia et al. | 84/322 |
| 2009/0056521 | A1 | 3/2009 | Goad | |
| 2013/0104722 | A1 * | 5/2013 | Bordelon | 84/322 |

* cited by examiner

MULTI-PURPOSE PLECTRUM

BACKGROUND OF THE INVENTION

1. Field of the Invention

The present invention relates to a plectrum for picking or strumming the strings of a musical instrument. In particular, it relates to a plectrum with multiple string engaging projections.

2. Description of the Related Art

Plectrums have long been used to pluck or strum the strings of certain string instruments such as guitars, banjos, harps, ukuleles, mandolins, and dulcimers. Different types of picks are generally associated with particular methods of use.

Plectrums are commonly a flat piece of plastic, wood, bone, shell, metal, or other suitable material. These materials vary in stiffness and may be used to produce different tones and textures of sounds. Varying the thickness of any of the materials may also produce variations in sound when strings are plucked or strummed.

Plectrums are also made in various shapes such as triangular or tear-drop. Factors affecting the sound produced by plucking or strumming a string with a plectrum include the gripping point between the thumb and finger, the distance of the playing edge from the gripping point, and the thickness of the playing edges.

One problem with a flat plectrum is maintaining a firm and consistent grip. Another problem is that a variety of playing edges may be required to vary the tone and the typical plectrum has a limited number of playing edges available. As a result, the player of an instrument may find it necessary to change to a different plectrum when he wishes to vary the tone of the instrument or his playing style.

The plectrum described herein aims at minimizing some of the problems associated with typical flat plectrums by providing a plectrum with a variety of playing edges and a means of obtaining a secure and consistent grip on the plectrum.

SUMMARY OF THE INVENTION

A plectrum includes a first lobe, a second lobe, a third lobe, a recessed edge between the first lobe and second lobe, and a convex edge between the first lobe and the third lobe. The plectrum is configured such that the third lobe projects from between the forefinger and thumb of the user to engage a string of a string instrument when the plectrum is grasped by a user with the recessed edge nesting against the web between the thumb and forefinger of the user, and with the second lobe on the palm side of the user's hand.

These and other features of the present invention will become readily apparent upon further review of the following specification and drawings.

DETAILED DESCRIPTION OF THE PREFERRED EMBODIMENTS

It is to be understood that the present invention is not limited to the embodiments described above, but encompasses any and all embodiments within the scope of the following claims. Practitioners skilled in the art will recognize numerous other embodiments as well. For a definition of the complete scope of the invention, the reader is directed to the appended claims.

Figure 1:
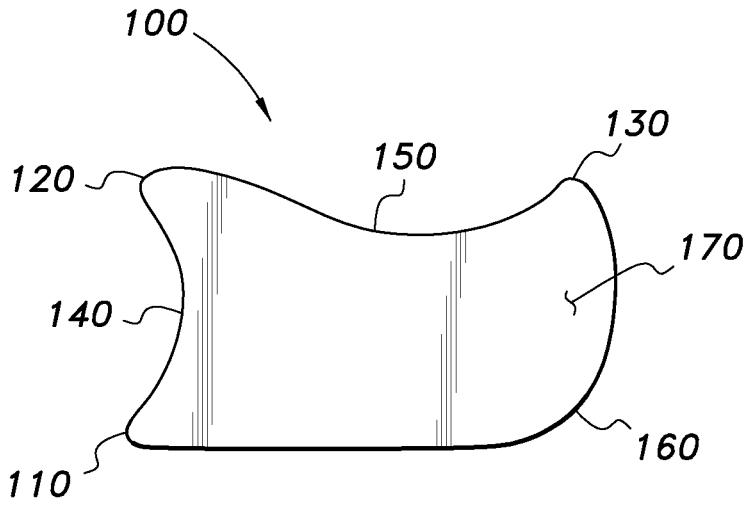
FIG. 1 is a plan view of the anterior side of an embodiment of the plectrum.
Figure 2:
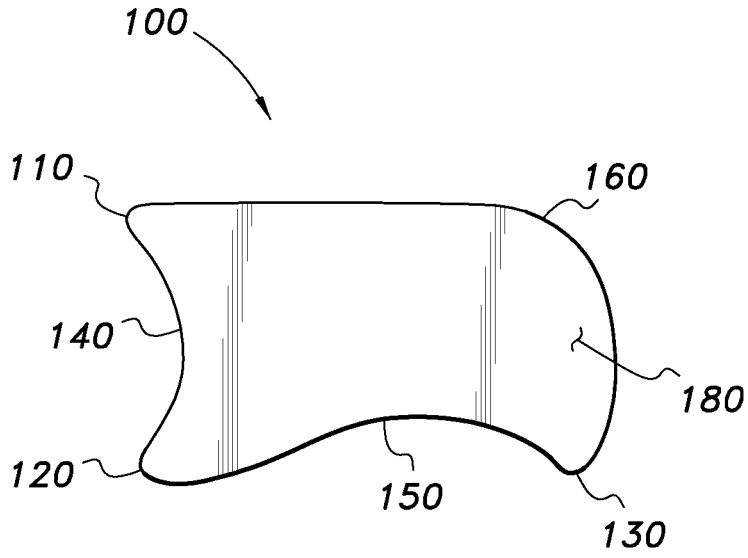
FIG. 2 is a plan view of the posterior side of the embodiment of the plectrum shown in FIG. 1.

Referring to the accompanying drawings, FIGS. 1 and 2 show plan views of opposite sides of a plectrum 100. Plectrum 100 may comprise first lobe 110, second lobe 120, third lobe 130, first recessed edge 140, second recessed edge 150, convex edge 160, anterior surface 170, and posterior surface 180. First lobe 110, second lobe 120, third lobe 130, and convex edge 160 may be used by the player of a string instrument as playing edges. While lobes 110, 120, and 130 are shown as having rounded edges, one or more of the lobes may have straight edges.

Anterior surface 170 and posterior surface 180 may define planes parallel to each other or may taper at one or more edges. While shown as flat, plectrum 100 may be contoured to fit a user's hand. Plectrum 100 may be made of plastic, wood, bone, shell, metal, or other suitable material known in the art.

Figure 3:
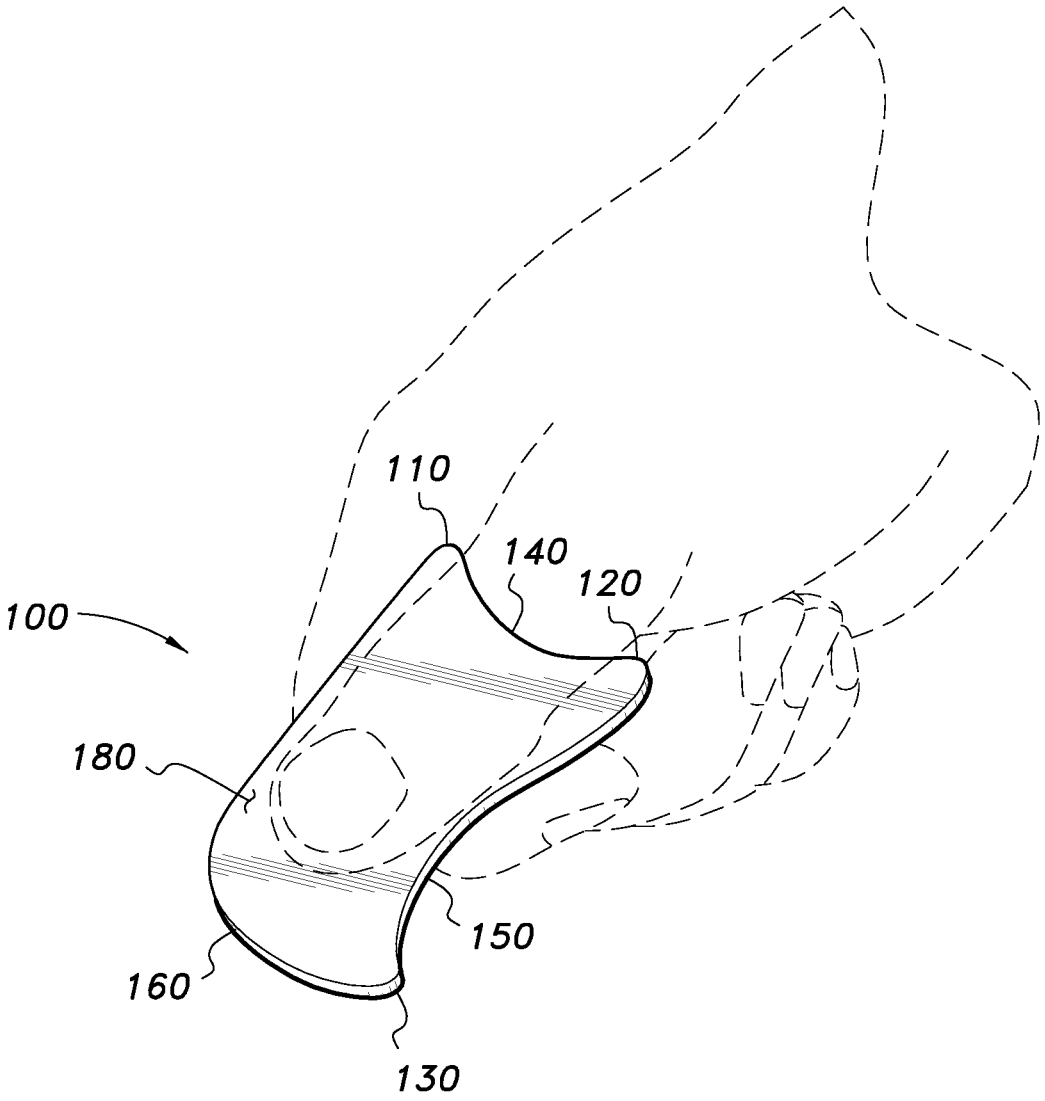
FIG. 3 is a plan view of a first grasping position of the embodiment of the plectrum shown in FIG. 1.

Plectrum 100 may be dimensioned such that, as in the first grasping position shown in FIG. 3, with a user holding plectrum 100 with first recessed edge 140 against the web between the thumb and forefinger of his right hand, and right thumb resting on posterior surface 180, third lobe 130 may be in position to strum or pluck the strings of a string instrument. In this position within a user's hand, first recessed edge 140 may act as a reference edge, helping a user hold the plectrum in a consistent position from one playing session to another. First lobe 110 and second lobe 120 may rest on either side of the web between the thumb and forefinger, helping secure plectrum 100 within the user's hand and reducing the likelihood of plectrum 100 slipping or rotating within a user's hand. The user may place his thumb and/or forefinger in different positions with respect to third lobe 130 to vary the distance between the gripping point and playing edge of third lobe 130, adjusting the flexibility of the playing edge. Adjusting the flexibility of the playing edge by varying the gripping point allows a user of plectrum 100 to vary the tone of engaged strings without changing to a different plectrum.

Figure 4:
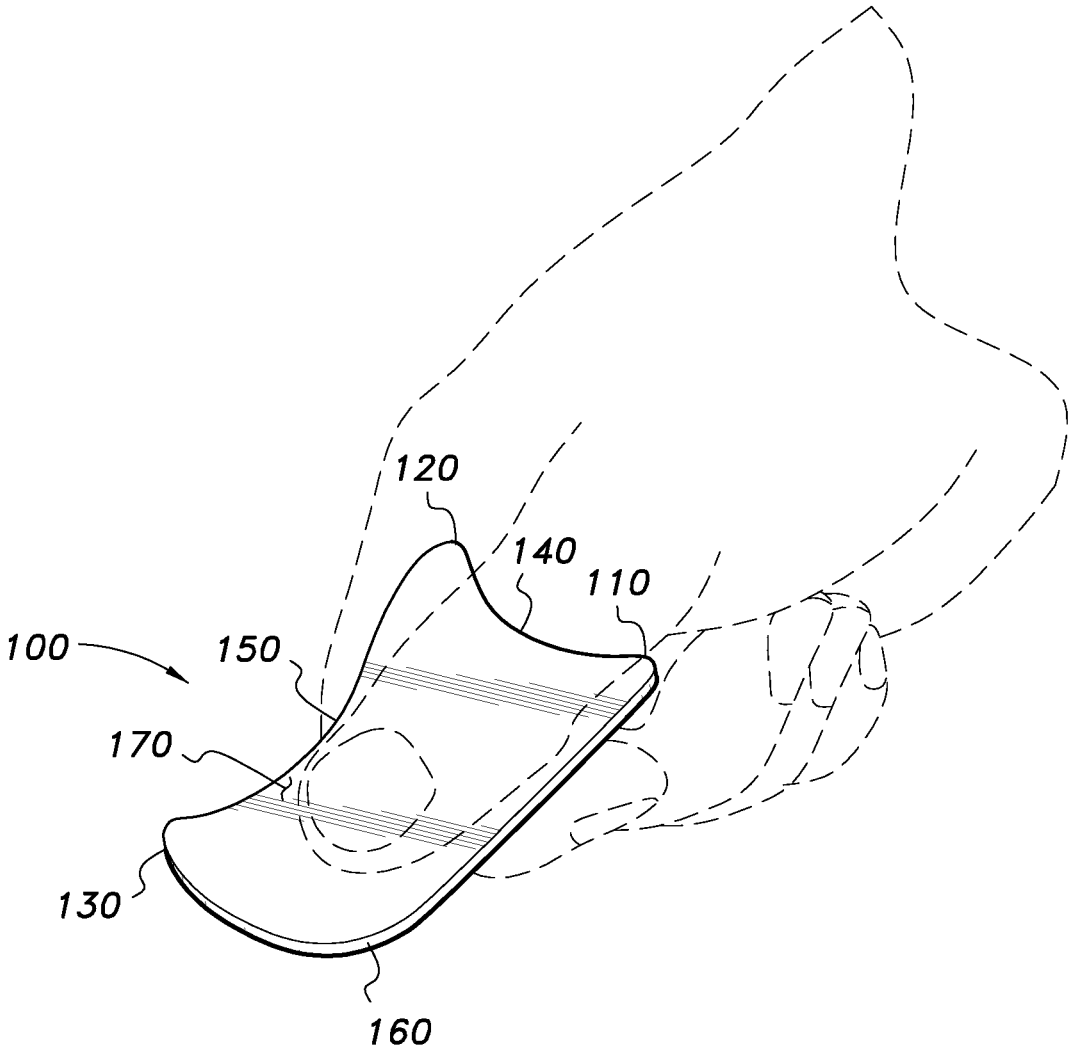
FIG. 4 is a plan view of a second grasping position of the embodiment of the plectrum shown in FIG. 1.

Alternatively, a user may hold plectrum 100 with first recessed edge 140 against the web between the thumb and forefinger of the right hand, and right thumb resting on anterior surface 170, as shown in the second grasping position of FIG. 4. This grasping position may place convex edge 160 in position to strum or pluck the strings of a string instrument. Convex edge 160, having a much larger radius than third lobe 130, may provide a more rigid playing edge than third lobe 130. As described above, first recessed edge 140 may act as a reference edge, with first lobe 110 and second lobe 120 helping to provide a secure grip on plectrum 100 by straddling the web between the thumb and forefinger of the user's hand.

When held in the second grasping position, plectrum 100 can engage the strings to make a soft "raking" sound. Turning plectrum 100 slightly while holding it in the second grasping position allows a user to engage in hard strumming of the strings.

Figure 5:
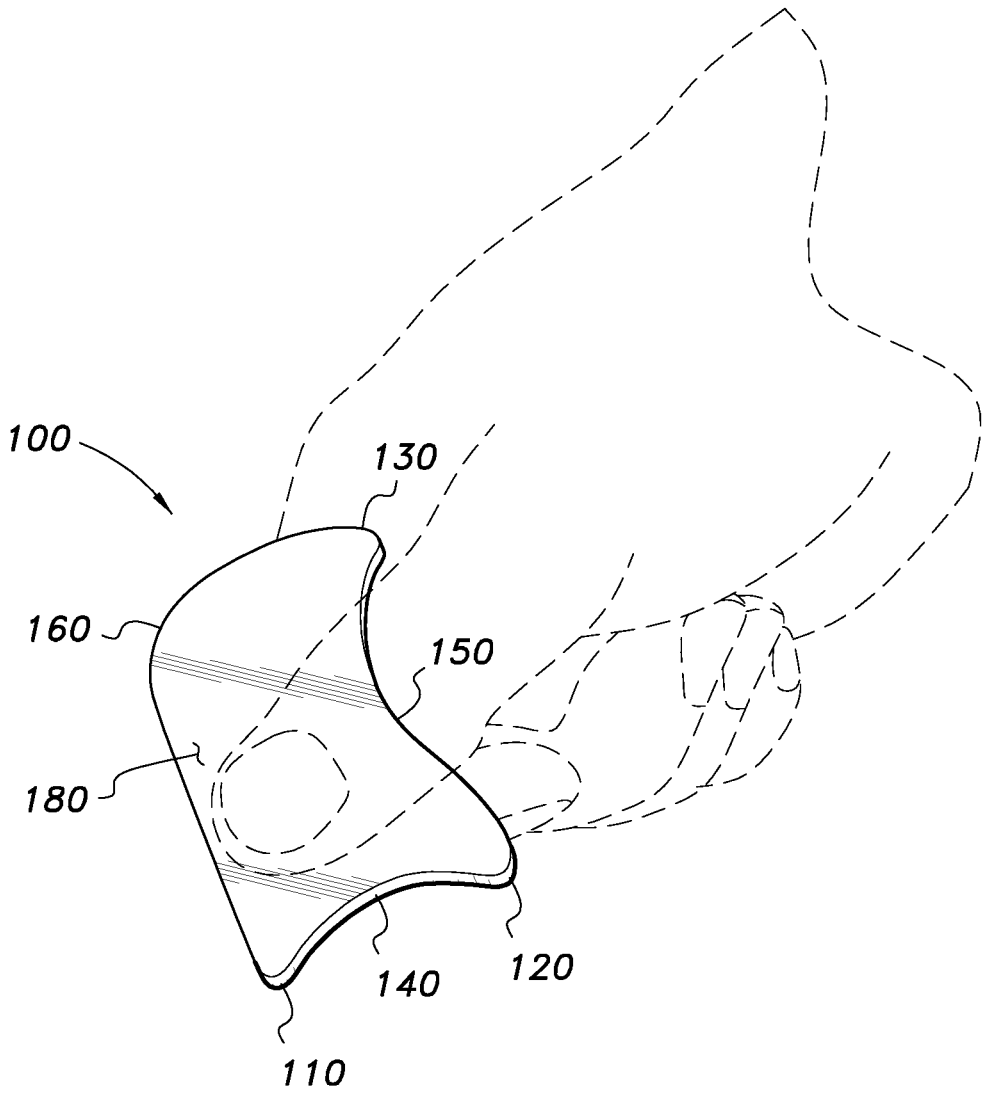
FIG. 5 is a plan view of a third grasping position of the embodiment of the plectrum shown in FIG. 1.

Plectrum 100 may also be grasped in a third position as shown in FIG. 5, with second recessed edge 150 resting against the web between the thumb and forefinger of the right hand, and right thumb resting on posterior surface 180. As described above with respect to first recessed edge 140, second recessed edge 150 may act as a reference edge, helping a user hold plectrum 100 in a consistent position from one playing session to another. This grasping position may place first lobe 110 and second lobe 120 in position to strum or pluck the strings of a string instrument.

In the third grasping position, plectrum 100 may be rocked back and forth to strike a single string of a string instrument alternately with first lobe 110 and second lobe 120. Plectrum 100 may also be placed at an angle in relation to the strings of a string instrument such that first lobe 110 plucks a first string while second lobe 120 plucks a second string of a string instrument simultaneously, producing a sound similar to that of a 12-string guitar.

While the above has been described with respect to a user holding plectrum 100 in the right hand, it is to be understood that plectrum 100 can be used by holding plectrum 100 in the left hand, with the anterior surface 170 and posterior surface 180 reversed in the description.

It is to be understood that the present invention is not limited to the embodiments described above, but encompasses any and all embodiments within the scope of the following claims.

I claim:

1. A plectrum comprising:

a first lobe;

a second lobe;

a third lobe;

a first recessed edge between the first lobe and the second lobe; and a convex edge between the first lobe and the third lobe, wherein the plectrum is configured such that the third lobe projects from between the forefinger and thumb of the user to engage the string of a string instrument when the plectrum is grasped by a user with the first recessed edge resting against the web between the thumb and the forefinger of a user's hand, and the second lobe on the palm side of the user's hand.

2. The plectrum of claim 1, further configured such that the convex edge projects from between the forefinger and the thumb of the user to engage a string of a string instrument when the plectrum is grasped by a user with the first recessed edge resting against the web between the thumb and forefinger of a user, and the first lobe is on the palm side of the user's hand.

3. The plectrum of claim 1, further configured such that the plectrum may be grasped to allow simultaneous engagement of a first string of a string instrument by the first lobe and a second string of the string instrument by the second lobe.

4. The plectrum of claim 1, wherein at least one of the first lobe, second lobe, and third lobe has a curved edge.

5. The plectrum of claim 1, wherein at least one of the first lobe, second lobe, and third lobe has a rectilinear edge.

6. The plectrum of claim 1, further comprising a second recessed edge, the second recessed edge being located between the second lobe and the third lobe.

7. The plectrum of claim 1, further comprising an anterior side and a posterior side, wherein the anterior side and posterior side define parallel planes.

8. A plectrum comprising:

a first string engagement section;

a second string engagement section; and a third string engagement section, the third engagement section comprising two playing edges, wherein the two playing edges of the third string engagement section are configured to rest on opposite sides of the web between the thumb and forefinger of a user's hand when the first string engagement section is being used to engage a string of a string instrument.

9. The plectrum of claim 8, wherein the third string engagement section further comprises a first reference edge, the first reference edge being configured to rest against the web between the thumb and forefinger of a user's hand when a user of the plectrum holds the plectrum to engage a string of the string instrument with the first string engagement section.

10. The plectrum of claim 8, further configured to allow a user to grasp the plectrum to simultaneously engage two strings of a string instrument using the two playing edges of the third string engagement section.

11. The plectrum of claim 8, further comprising a recessed section between the first string engagement section and the third string engagement section.

12. The plectrum of claim 11, wherein the recessed section between the first string engagement section and the third string engagement section acts as a second reference edge, the second reference edge being used when a user holds the plectrum to engage a string with the third string engagement section.

13. The plectrum of claim 8, further comprising an anterior surface defining a first plane and a posterior surface defining a second plane, the second plane being parallel to the first plane.

14. A plectrum comprising:

a retention feature adapted to rest against the web of a user's hand between the thumb and the forefinger, wherein the retention feature comprises a third string engagement section and a fourth string engagement section;

a first string engagement section; and a second string engagement section.

15. The plectrum of claim 14, wherein the plectrum is configured to allow a user to simultaneously engage a first string of a string instrument with the third string engagement section and a second string of the string instrument with the fourth string engagement section.

16. The plectrum of claim 14, further comprising an anterior surface defining a first plane and a posterior surface defining a second plane, the second plane being parallel to the first plane.

17. The plectrum of claim 14, wherein the retention feature comprises a first reference edge, the first reference edge being adapted to facilitate the grasping of the plectrum in a consistent way when a user holds the plectrum to engage a string of a string instrument with the first string engagement section.

18. The plectrum of claim 14, further comprising a recessed section between the second string engagement section and the retention feature.

19. The plectrum of claim 17, wherein the recessed section between the second string engagement section and the retention feature is adapted to act as a second reference edge, wherein the second reference edge is adapted to rest against the web of a user's hand between the thumb and the forefinger when a user holds the plectrum to engage a string of a string instrument with the third string engagement section.

* * * * *